United States Patent [19]

Kahn

[11] Patent Number: 4,641,341

[45] Date of Patent: Feb. 3, 1987

[54] AUTOMATIC MULTI-SYSTEM AM STEREO RECEIVER USING EXISTING SINGLE-SYSTEM AM STEREO DECODER IC

[76] Inventor: Leonard R. Kahn, 137 E. 36th St., New York, N.Y. 10016

[21] Appl. No.: 770,170

[22] Filed: Aug. 28, 1985

[51] Int. Cl.[4] ..... H04H 5/00

[52] U.S. Cl. ..... 381/15; 329/131; 329/146; 329/178

[58] Field of Search ..... 381/15, 16; 329/131, 329/146, 147, 178; 455/137, 142

[56] References Cited

U.S. PATENT DOCUMENTS 4,420,658 12/1983 Loughlin ..... 381/15

4,426,728 1/1984 Kahn ..... 381/15

4,535,470 8/1985 Yokoya et al. ..... 381/15

4,536,885 8/1985 Loughlin ..... 381/15

*Primary Examiner*—Forester W. Isen

*Attorney, Agent, or Firm*—E. A. Onders; F. R. Agovino

[57] ABSTRACT

Disclosed is an AM stereo receiver capable of receiving signals representing at least two different types of AM stereo systems, but using an integrated circuit (IC) decoder designed to properly decode received signals representing only one of the two types of systems. The receiver includes circuitry coupled to the IC which adapts the IC for also properly decoding received signals representing the second type of AM stereo system as well. Circuitry is also disclosed for automatically detecting which type of AM stereo system is being received and for configuring the receiver's decoding circuits to properly decode the received stereo signals.

5 Claims, 3 Drawing Figures

AUTOMATIC MULTI-SYSTEM AM STEREO RECEIVER USING EXISTING SINGLE-SYSTEM AM STEREO DECODER IC

BACKGROUND OF THE INVENTION

Unlike the case of color television broadcasting, where a single system (the NTSC system) was approved by the Federal Communications Commission (FCC) for use in the United States, the FCC did not establish a single-system standard when it authorized stereo AM broadcasting to begin in 1982. As a result, any system may be used by AM broadcasters so long as it meets certain minimum technical specifications which the FCC imposed. In fact initially four different systems were used by AM broadcasters. These were known as the Harris, Kahn/Hazeltine, Magnavox and Motorola systems. Since then, use of the Harris and Magnavox systems has been effectively discontinued, so that at the time of this writing only the Kahn/Hazeltine and Motorola systems remain in use in the United States. Hence, the need arose for a multi-system AM stereo receiver, which automatically recognizes and selects appropriate stereo signal decoding circuitry for the particular AM stereo system signal being received at the time. Such a receiver must also be compatible with conventional monophonic AM broadcasts. Furthermore, such receivers should preferably be inexpensive, and for this purpose preferably make use of existing integrated circuits (IC's), instead of requiring the development of new custom IC's in order to achieve this purpose.

It is, therefore, an object of the present invention to provide a multi-system AM stereo receiver which is compatible with monophonic AM broadcasts, and which is capable of receiving and properly decoding AM stereo broadcasts using the Kahn/Hazeltine and Motorola systems, but which does so automatically and using existing IC's.

SUMMARY OF THE INVENTION

In accordance with the present invention there is provided an AM stereo receiver capable of receiving signals representative of at least first and second different types of AM stereo systems, but using an integrated circuit (IC) stereo signal decoder designed to properly decode only received signals representing the first type of AM stereo system. Such a receiver includes means for receiving AM radio frequency signals and for converting such signals to corresponding intermediate frequency (IF) signals. The receiver also includes first means, including an IC designed to properly decode received IF signals representing the first type of AM stereo system, for developing a first pair of left (L) and right (R) stereo audio signals from received IF signals which represent the first type of AM stereo system. The receiver further includes second means, coupled to such IC, for adapting the first means so as to develop a second pair of (L) and (R) stereo audio signals from received IF signals which represent the second type of AM stereo system. Finally, the receiver includes means coupled to the first and second means for selecting one or the other of such pairs of (L) and (R) stereo audio signals and for coupling the selected pair to (L) and (R) audio outputs of the receiver.

In accordance with another aspect of the invention there is provided an AM stereo receiver capable of receiving signals representative of a second type of AM stereo system, but using an IC stereo signal decoder designed to properly decode only received signals representative of a first type of AM stereo system. Such a receiver includes means for receiving AM radio frequency signals and for converting such signals to corresponding IF signals. The receiver also includes an IC designed to properly decode only IF signals representing the first type of AM stereo system, such IC having a plurality of terminals including: a first terminal at which the IC develops an output signal representative of the envelope of said IF signals; a second terminal for receiving said IF signals as an input thereto; a third terminal at which the IC develops an output error signal "X"; a fourth terminal at which the IC develops an output signal representative of left (L) stereo information; a fifth terminal at which the IC develops an output signal representative of right (R) stereo information; a sixth terminal at which the IC develops an output signal representative of any low frequency phase modulation below about 30 Hz in IF signals applied to such second terminal; a seventh terminal for receiving supplied low frequency signals of about 25 Hz, and; an eighth terminal at which the IC develops an output signal representative of quadrature phase components in said IF signals; means coupled to said third terminal for disabling said error signal; means coupled to said first and eighth terminals for shifting the phase of the signals present at said terminals so as to have a relative phase difference of approximately 90° over at least a selected portion of the frequency band they occupy; means for combining said phase shifted signals to produce a pair of audio frequency output signals representative of (L) and (R) information in said IF signals; means coupled to said sixth and eighth terminals for detecting and indicating the presence of a low frequency tone of about 15 Hz in said IF signals which represents the presence of AM stereo signals of said second type in said IF signals; means coupled to said detecting and indicating means, for disabling the output of said combining means except when said 15 Hz tone is detected; means coupled to said fourth and fifth terminals and to said detection and indicating means, for disabling the signals present at said terminals when said 15 Hz tone is detected; means coupled to said source of IF signals, and to said first terminal, for inversely amplitude modulating said IF signals in accordance with a selected function of the output signal appearing at said first terminal, and; means coupled to said first terminal and to said amplitude modulating means, and to said detection and indicating means, for disabling the output of said amplitude modulating means when a 25 Hz tone is detected.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENTS

Figure 1:
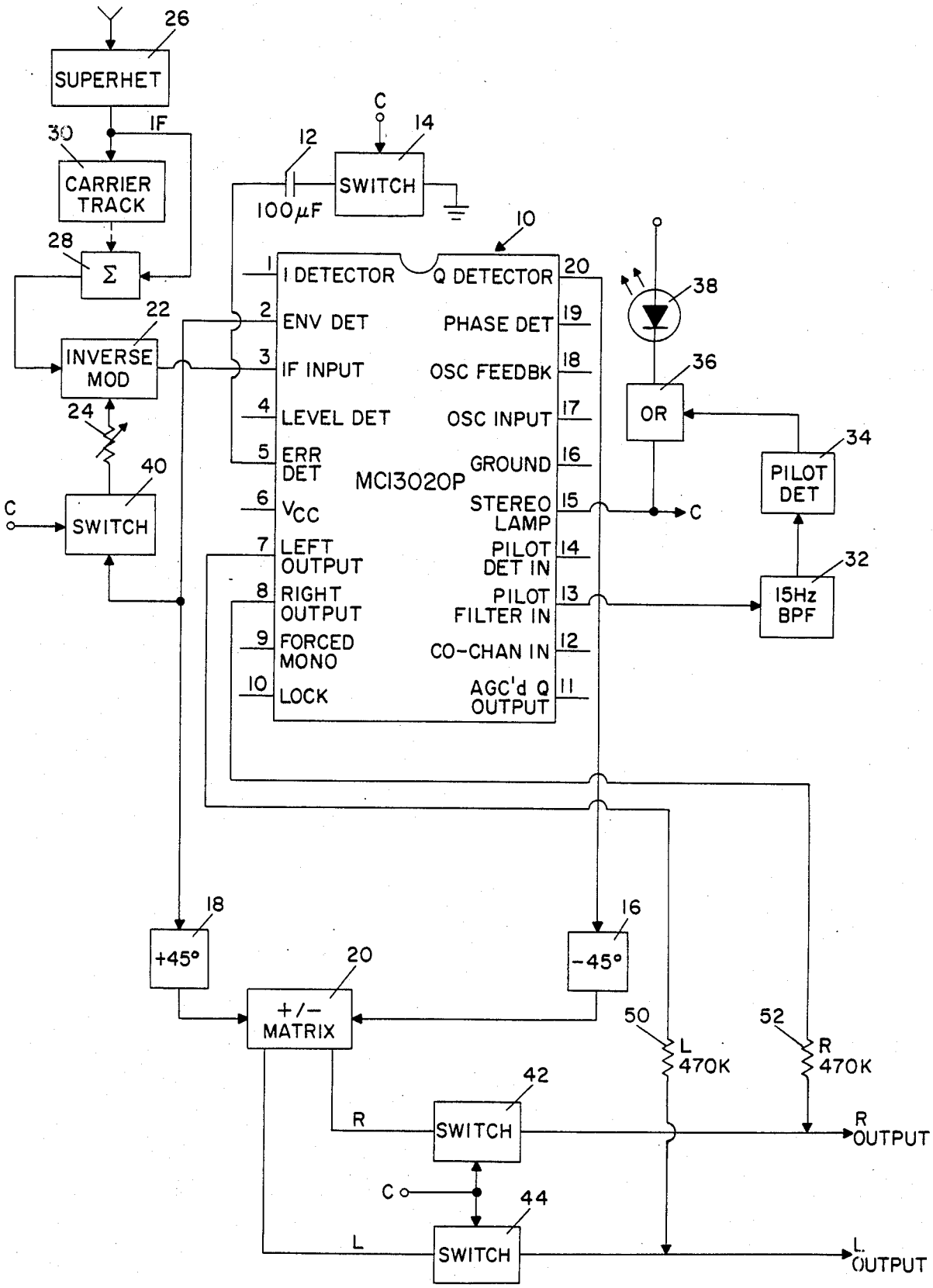
FIG. 1 is a block diagram of a compatible multi-system AM stereo receiver which embodies the present invention in one form.

The embodiment shown in FIG. 1 makes novel use of an existing commercially available IC known as the MC13020P which is manufactured by the Motorola Corporation. It has been publically announced by Motorola, however, that at least two other companies have been licensed to manufacture this IC. It is understood that a variant of this IC is manufactured by Motorola specially for the General Motors Corporation and bears Delco Part No. DM-235. Although the description of the invention set forth herein refers specifically to the Motorola MC13020P, it will be readily apparent to those skilled in the art that equivalent AM stereo decoder IC's may be substituted, such as the Delco part identified above.

The Motorola IC is intended to be used in an AM stereo receiver to properly decode in stereo only AM stereo signals which were broadcast using the Motorola compatible quadrature system of AM stereo transmission. However, as is more fully described hereinafter, by adding a few external circuit components to the IC, the receiver can be adapted into one which is capable of also properly decoding AM stereo signals which are broadcast using the Kahn/Hazeltine Independent Sideband system of AM stereo transmission. Thus, the present invention enables a so-called "single-system" (Motorola) AM stereo receiver, having limited utility, to be readily converted into a so-called "multi-system" (Motorola and Kahn/Hazeltine) AM stereo receiver having greater utility, since presently both AM stereo systems are in use in the United States by AM radio stations.

Motorola IC MC13020P, denoted in the drawings with the reference numeral 10, is fully described in Motorola Semiconductors' published leaflet #ADI-725, which is incorporated herein by reference. This leaflet also shows the components required external to the IC for operation of the IC as a Motorola AM stereo system decoder. Unless noted herein, those components remain unaffected by the present invention and, for purposes of clarity, are not shown in the drawings. Although the IC has a total of 20 terminals, only 8 of these are affected by the present invention.

These are:

terminal 2, identified by Motorola as the envelope detector output, hereinafter sometimes referred to as the "first terminal";

terminal 3, identified as the IF input, hereinafter sometimes referred to as the "second terminal";

terminal 5, identified as the error amplifier output, hereinafter sometimes referred to as the "third terminal";

terminal 7, identified as the left or (L) output, hereinafter sometimes referred to as the "fourth terminal";

terminal 8, identified as the right or (R) output, hereinafter sometimes referred to as the "fifth terminal";

terminal 13, identified as the pilot filter input, hereinafter sometimes referred to as the "sixth terminal";

terminal 15, identified as the stereo lamp control output, hereinafter sometimes referred to as the "seventh terminal"; and terminal 20, identified as the Q or quadrature detector output, hereinafter sometimes referred to as the "eighth terminal".

In the embodiment of the present invention shown in FIG. 1, error signal disabling means, for example in the form of a capacitor 12 in series with a normally closed electronic switch 14, is connected between terminal 5, the "third terminal", and ground, so that any error signal which may appear at this terminal is suppressed or "killed". Phase shifting means, in the form of a phase angle advancing network 18 for example, advances the phase of signals applied to it by approximately 45° (actually delaying them by 315°) over at least a portion of the audio frequency band of the receiver and is connected to terminal 2, the "first terminal", on which a signal representing (L+R) information appears. Similarly, a 45° phase angle delay network 16 is connected to terminal 20, the "eighth terminal", on which a signal representing (L−R) information appears.

In the Kahn/Hazeltine AM stereo system, at the transmitter (L+R) and (L−R) information is placed substantially in quadrature. Then, the (L−R) signal is used to phase modulate a carrier and the (L+R) signal is used to amplitude modulate the phase-modulated carrier in one embodiment. Phase shift networks 18 and 16 in the receiver of FIG. 1 are intended to complement this process so that the resulting phase shifted (L+R) and (L−R) signals, respectively, which are applied to a conventional sum and difference matrix 20 will be in the proper phase relationship to develop L and R representative audio signals at the outputs of the matrix.

In receivers for the Kahn/Hazeltine and Motorola systems the amplitude modulation in the intermediate frequency (IF) signal is reduced by a selected amount prior to demodulation in a synchronous quadrature demodulator in order to reduce distortion which would otherwise occur in the resulting (L−R) representative audio signal that is developed at the output of the quadrature demodulator. This distortion reduction technique, sometimes refered to as inverse amplitude modulation, is described more fully in U.S. Pat. No. 4,018,994. However, different amounts of inverse amplitude modulation are required for the two different AM stereo systems. Circuitry is provided within the Motorola IC to produce the necessary amount of reduction in the amplitude modulation of a Motorola AM stereo IF signal before it is applied to a quadrature demodulator so as to achieve distortion reduction. Since components associated with this circuitry are not accessible from outside the IC, in the embodiment of FIG. 1 external components are added in accordance with the present invention to produce the desired amount of reduction in the amplitude modulation of a Kahn/Hazeltine AM stereo IF signal before it is applied to the quadrature demodulator so as to achieve distortion reduction. The reduction in amplitude modulation is accomplished in a separate inverse modulator 22, which is controlled by the output of the envelope detector in the IC, which output appears on terminal 2, the "first terminal". The amount of inverse modulation is adjustable by attenuation means, such as a variable resistor 24.

If desired, the AM stereo receiver may be adapted to use an IF signal which has had its carrier exalted. This is accomplished by carrier exalting means, implemented in FIG. 1, for example, by the combination of carrier recovery circuit 30, which may be a phase-locked loop, and an adder circuit 28. The IF signal with its carrier exalted is obtained at the output of the adder circuit 28, and may be fed therefrom to the inverse modulator 22 instead of the normal IF signal available at the output of superhetrodyne receiving circuit 26.

Since the multiple-system AM stereo decoder of FIG. 1 develops two different sets of (L) and (R) signals, a pair of electronic switches 42 and 44 is provided for the purpose of allowing the set of (L) and (R) signals available from matrix 20 to be coupled to the L and R outputs when a Kahn/Hazeltine AM stereo system broadcast is being received and decoded or, alternatively, at all times except when a Motorola system broadcast is being received and decoded. In addition, in the particular embodiment shown in FIG. 1, a pair of resistors 50 and 52 are used in series with the outputs from the fourth and fifth terminals of the IC to reduce the level of the (L) and (R) signals available from these terminals so as to match that of the (L) and (R) signals from switches 42 and 44, so that a difference in level is not heard when switching from a station broadcasting with the Kahn/Hazeltine system to one broadcasting with the Motorola system, or vice versa. Alternatively, if appropriate gain were provided in matrix 20 for its output (L) and (R) signals, resistors 50 and 52 could be deleted.

Since the receiver of FIG. 1 is capable of receiving either Kahn/Hazeltine or Motorola AM stereo system broadcasts, using different and alternative circuitry, additional circuitry must be provided to automatically switch the receiver's stereo decoding circuitry between its two different modes of operation, depending upon which of the two AM stereo systems is being received. Fortunately, each AM stereo broadcast signal contains a low frequency stereo pilot tone which identifies which AM stereo system it represents. AM stereo receivers must be able to recognize the different pilot tones, and upon recognition, switch to the appropriate stereo signal decoding mode. For the Kahn/Hazeltine system the pilot tone frequency is 15 Hz, whereas the Motorola system uses 25 Hz.

Switching between the two different modes of stereo operation is accomplished by providing a separate bandpass filter 32 and pilot detector 34 coupled to terminal 13 of the IC, or the "sixth" terminal. Bandpass filter 32 has a narrow passband centered at 15 Hz for enabling pilot detector 34 to detect the Kahn/Hazeltine system pilot, thereby developing a control signal indicating reception of a Kahn/Hazeltine AM stereo system broadcast. The Motorola IC includes a pilot detector for the 25 Hz Motorola AM stereo system pilot tone. When a 25 Hz tone is detected, a signal appears on terminal 15, the "seventh" terminal. This signal is coupled to one input of an OR circuit 36, the other input of which is fed by the output of the Kahn/Hazeltine pilot tone detector 34. The output of the OR circuit 36 is coupled to an indicator, such as an LED (light emitting diode) 38, which serves to indicate to a user that an AM stereo signal is being received but does not identify the type of AM stereo system being used.

When a Motorola AM stereo system signal is being received, the Kahn/Hazeltine system related circuits should be disabled. This is accomplished by the signal appearing at the "seventh terminal" being fed: (1) to electronic switch 14, disabling the error signal killing circuit 12; (2) to electronic switch 40, disabling the inverse modulator 22; and (3) to the pair of electronic switches 42 and 44, opening them so that the (L) and (R) outputs of matrix circuit 20 are not coupled to the (L) and (R) outputs of the receiver. In this case the (L) and (R) outputs from the Motorola IC are the (L) and (R) outputs of the receiver.

Figure 2:
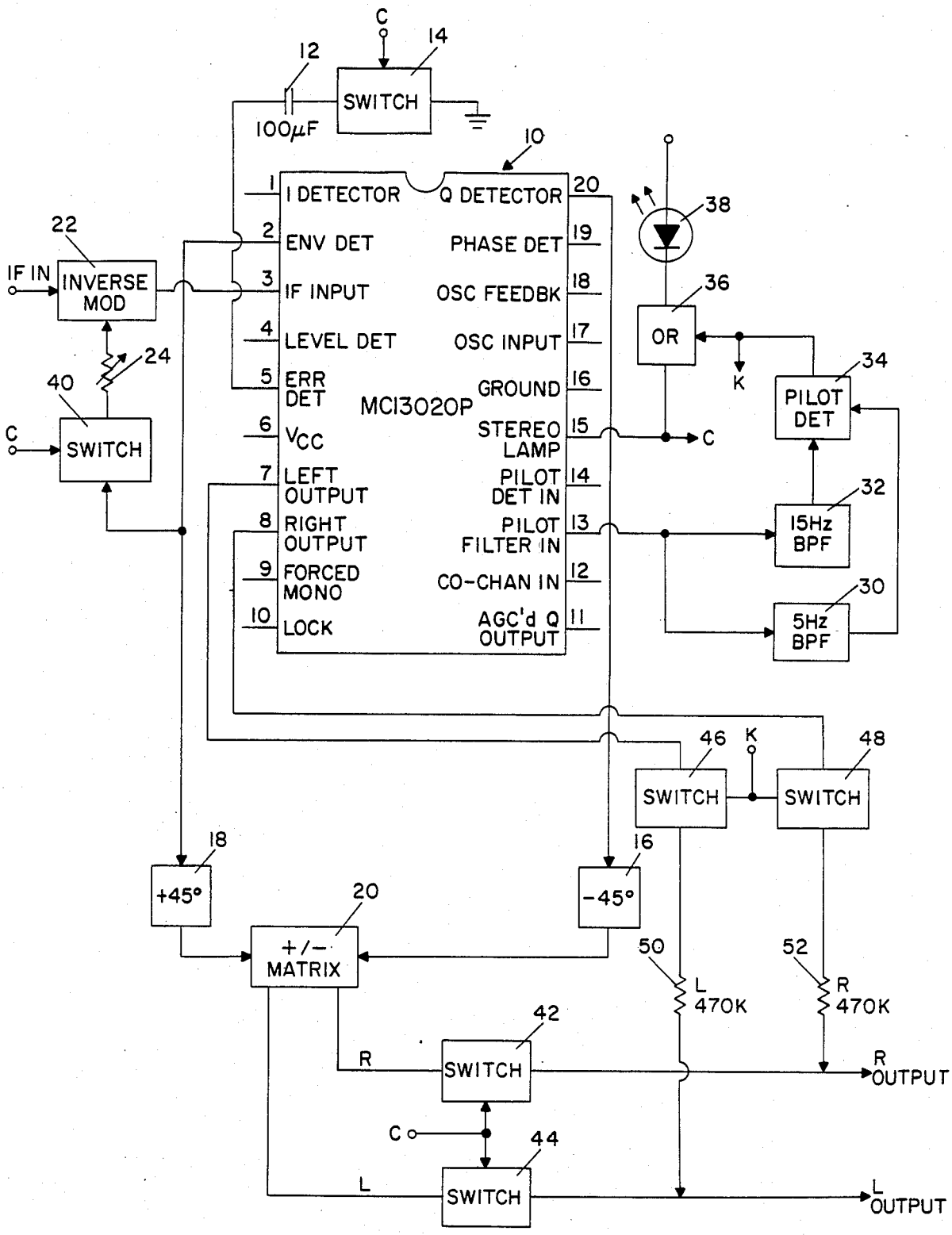
FIG. 2 is block diagram showing a modification of the embodiment of FIG. 1.

Conversely, when a Kahn/Hazeltine AM stereo signal is received, it is assumed that no (L) and (R) signals exist at the "fourth and fifth" terminals of the Motorola IC. In this case switches 14, 40, 42 and 44 are all closed and the (L) and (R) signals from matrix 20 are passed to the (L) and (R) outputs of the receiver. In the drawing shown, all terminals labelled "C" are interconnected for this purpose. If interfering signals are found to exist at the "fourth and fifth" terminals of the IC during reception of Kahn/Hazeltine system broadcasts, an additional pair of electronic switches 46 and 48 may be added as shown in FIG. 2. Switches 46 and 48 are arranged so as to pass signals from the "fourth and fifth" terminals of the Motorola IC to the (L) and (R) outputs of the receiver only when the "seventh" terminal indicates that a Motorola AM stereo system broadcast is being received.

Figure 3:
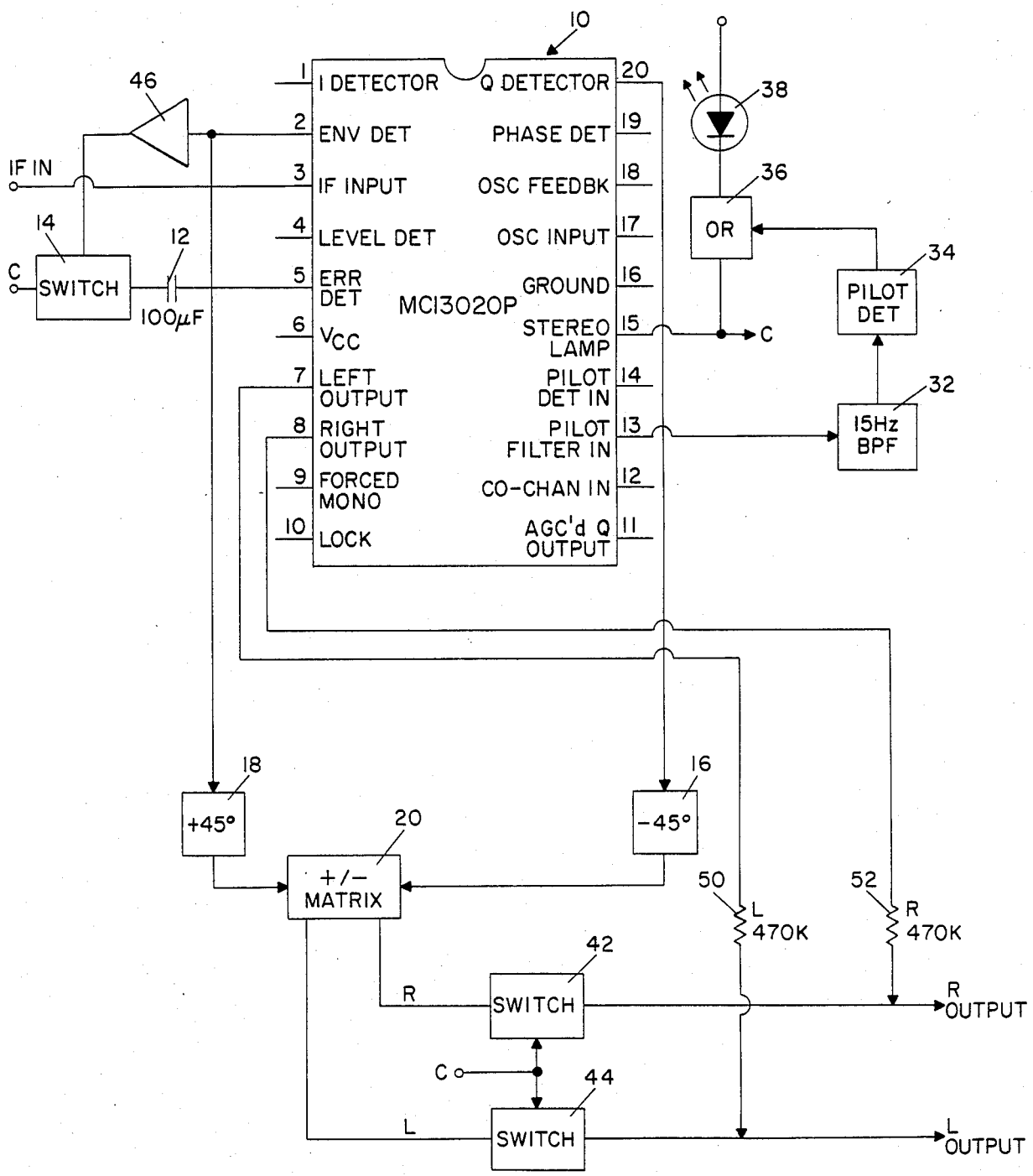
FIG. 3 is a block diagram of another embodiment of the invention.

In an alternative embodiment of the invention shown in FIG. 3, the error signal disabling or killing circuit is implemented in the novel manner shown. As in the embodiment of FIG. 1, the output from the "third terminal", terminal 5 of the IC, on which an error signal appears, is coupled to one terminal of a 100 μF capacitor 12', the other terminal of the 100 μF capacitor 12' being connected to the output of an electronic switch 14', whose input is connected to the output of a low output impedance operational amplifier 46. The input of the operational amplifier 46 is connected to the "first terminal", namely terminal 2 of the IC, at which the output of the envelope detector normally appears. In this embodiment, the low output impedance of the operational amplifier 14 effectively suppresses or kills the error signal present at terminal 5 (generated within the IC) and, at the same time, also controls the inverse modulation process which occurs within the IC, so that no additional inverse modulator is required external to the IC.

While there have been described what are believed to be the preferred embodiments of the invention, those skilled in the art will recognize that other and further modifications may be made thereto without departing from the spirit of the invention, and it is intended to claim all such changes and modifications as fall within the true scope of the invention.

What is claimed is:

1. An AM stereo receiver capable of receiving signals representative of at least first and second different types of AM stereo systems, but using an integrated circuit (IC) stereo signal decoder designed to properly decode only received signals representing said first type of AM stereo system, comprising:

means for receiving AM radio frequency signals and for converting said signals to corresponding intermediate frequency (IF) signals;

first means, including an IC designed to properly decode received IF signals representing said first type of AM stereo system, for developing a first pair of left (L) and right (R) stereo audio signals from received IF signals which represent said first type of AM stereo system;

second means, coupled to said IC, for adapting said first means so as to develop a second pair of (L) and (R) stereo audio signals from received IF signals which represent said second type of AM stereo system; and means coupled to said first and second means for selecting one or the other of said pairs of (L) and (R) stereo audio signals and for coupling the selected pair to (L) and (R) audio outputs of said receiver.

2. An AM stereo receiver in accordance with claim 1 wherein the combination of said first and second means properly decodes received IF signals representing said second type of AM stereo system.

3. An AM stereo receiver in accordance with claim 2 wherein said first means includes a detector for a pilot signal component which is uniquely associated with received signals representing said first type AM stereo system, and wherein said second means includes means for adapting said pilot signal detector so as to also detect a pilot signal component which is uniquely associated with received signals representing said second type AM stereo system.

4. An AM stereo receiver in accordance with claim 2 wherein said second means includes means for inversely amplitude modulating said received IF signals prior to their being supplied to said IC when said received signals represent said second type of AM stereo system.

5. An AM stereo receiver capable of receiving signals representative of a second type of AM stereo system, but using an integrated circuit (IC) stereo signal decoder designed to properly decode only received signals representative of a first type of AM stereo system, comprising:

means for receiving AM radio frequency signals and for converting said signals to corresponding intermediate frequency (IF) signals;

an IC designed to properly decode only IF signals representative of said first type of AM stereo system, said IC having a plurality of terminals including:

a first terminal at which the IC develops an output signal representative of the envelope of said IF signals;

a second terminal for receiving said IF signals as an input thereto;

a third terminal at which the IC develops an output error signal "X";

a fourth terminal at which the IC develops an output signal representative of left (L) stereo information;

a fifth terminal at which the IC develops an output signal representative of right (R) stereo information;

a sixth terminal at which the IC develops an output signal representative of any low frequency phase modulation, below about 30 Hz, in IF signals applied to said second terminal;

a seventh terminal for supplying a signal indicating the presence in said IF signals of a pilot tone of said first type of AM stereo system; and an eighth terminal at which the IC develops an output signal representative of quadrature phase components in said IF signals;

means coupled to said third terminal for disabling said error signal;

means coupled to said first and eighth terminals for shifting the phase of the signals present at said terminals so as to have a relative phase difference of approximately 90° over at least a selected portion of the frequency band they occupy;

means for combining said phase shifted signals to produce a pair of audio frequency output signals representative of (L) and (R) information in said IF signals;

means coupled to said sixth terminal for detecting and indicating the presence of a low frequency tone of about 15 Hz in said IF signals which represents the presence of AM stereo signals of said second type in said IF signals;

means coupled to said detecting and indicating means, for disabling the output of said combining means except when said 15 Hz tone is detected;

means coupled to said fourth and fifth terminals and to said detection and indicating means, for disabling the signals present at said terminals when said 15 Hz tone is detected;

means coupled to said source of IF signals, and to said first terminal, for inversely amplitude modulating said IF signals in accordance with a selected function of the output signal appearing at said first terminal, and;

means coupled to said first terminal and to said amplitude modulating means, and to said seventh terminal, for disabling the output of said amplitude modulating means when a pilot signal of said first AM stereo system is detected.

* * * * *